US006128780A

United States Patent [19]

Reinhart et al.

[11] Patent Number: 6,128,780

[45] Date of Patent: Oct. 10, 2000

[54] BIB HAVING AN IMPROVED POCKET STRUCTURE

[75] Inventors: Richard Nicholas Reinhart; Patricia Lee Lampson; Amit Gupta, all of Cincinnati, Ohio

[73] Assignee: The Procter & Gamble Company, Cincinnati, Ohio

[21] Appl. No.: 08/969,868

[22] Filed: Nov. 14, 1997

[51] Int. Cl.[7] ..... A41B 13/00

[52] U.S. Cl. ..... 2/49.2

[58] Field of Search ..... 2/49.2, 49.3, 49.4

[56] References Cited

U.S. PATENT DOCUMENTS

| | | | |
|---|---|---|---|
| D. 238,521 | 1/1976 | Anderssen | D2/2 |
| 563,644 | 7/1896 | Birney . | |
| 879,124 | 2/1908 | Thompson . | |
| 1,591,721 | 7/1926 | Melvin . | |
| 2,164,369 | 7/1939 | Woolever | 2/49 |
| 2,423,489 | 7/1947 | Dunn . | |
| 2,551,907 | 5/1951 | Serebrin . | |
| 2,552,462 | 5/1951 | Savrin . | |
| 2,580,388 | 1/1952 | Allen | 2/49 |
| 3,010,110 | 11/1961 | Kirk . | |
| 3,010,111 | 11/1961 | Ralph | 2/49 |
| 3,407,407 | 10/1968 | Hollander et al. . | |
| 3,945,048 | 3/1976 | Shearer | 2/49 R |
| 4,233,688 | 11/1980 | Hjerl | 2/49 R |
| 4,261,057 | 4/1981 | Andersson | 2/49 R |
| 4,441,212 | 4/1984 | Ahr et al. | 2/49 R |
| 4,445,231 | 5/1984 | Noel | 2/49 R |
| 4,646,365 | 3/1987 | Suprise et al. | 2/49.2 |
| 4,649,572 | 3/1987 | Roessler | 2/49 R |
| 4,660,226 | 4/1987 | Quilling et al. | 2/49 R |
| 4,706,303 | 11/1987 | VanGompel et al. | 2/49 R |
| 4,780,911 | 11/1988 | Mack | 2/49 R |
| 5,218,721 | 6/1993 | Mathews et al. | 2/49.2 |
| 5,490,289 | 2/1996 | Lehrer . | |
| 5,715,542 | 2/1998 | Reinhart | 2/49.1 |
| 5,819,314 | 10/1998 | Jackson | 2/49.2 |
| 5,822,792 | 10/1998 | Reinhart, Jr. | 2/49.1 |

FOREIGN PATENT DOCUMENTS

| | | | |
|---|---|---|---|
| 2015867 | 9/1979 | United Kingdom | A41B 13/10 |
| WO 97/05793 | 2/1997 | WIPO | A41B 13/10 |

*Primary Examiner*—John J. Calvert
*Assistant Examiner*—Shirra L. Jenkins
*Attorney, Agent, or Firm*—Jay A. Krebs; Dave M. Wierich; Steve W. Miller

[57] ABSTRACT

A bib having an improved pocket. The bib has a body panel, a pocket panel, and a third panel disposed between the body panel and the pocket panel. The third panel helps to maintain the pocket in an open configuration.

8 Claims, 6 Drawing Sheets

BIB HAVING AN IMPROVED POCKET STRUCTURE

FIELD OF THE INVENTION

The present invention is related to disposable bibs, and more particularly, to a bib having an improved pocket structure for receiving spilled liquid and solid materials.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

The prior art also discloses bibs having a pocket structure for receiving solids or liquids which would otherwise soil the wearer's clothing. An example of a bib having such a pocket is disclosed in U.S. Pat. No. 4,445,231 issued May 1, 1984 to Noel. Noel discloses a bib having a gravitationally openable pocket.

Noel provides an improvement in pocket structures for use with bibs. However, Noel depends on gravitational forces acting on an apron panel to maintain a bib pocket in an open configuration. The effectiveness of such a design can be affected by the vertical orientation of the wearer and/or the bib. Accordingly, there remains a need for an inexpensive disposable bib having a pocket which can be maintained in an open configuration for receiving and holding spilled solid and liquid food material.

Accordingly, it is an object of the present invention to provide a disposable bib which can be conveniently secured to the wearer's person.

Another object of the present invention is to provide a disposable bib having a pocket structure for receiving spilled food material.

Another object of the present invention is to provide a disposable bib having pocket structure which can be maintained in an open configuration.

Another object of the present invention is to provide a disposable bib having a panel which extends into the pocket space of a disposable bib to maintain the pocket in an open configuration.

SUMMARY OF THE INVENTION

The present invention provides a disposable bib. The bib can comprise a bib body and a pair of shoulder extensions extending from the bib body to define a neck opening. The bib body can have a longitudinal length, a longitudinal centerline, and a lateral width.

The bib body comprises a first body panel, a second pocket panel, and a third panel. The second pocket panel is joined to the body panel for providing a pocket space intermediate the body panel and the pocket panel. The pocket space has a pocket open edge, a pocket longitudinal length, and a pocket lateral width.

The third panel is joined to the bib to extend at least partially into the pocket space, with at least a portion of the third panel being disposed between the body panel and the pocket panel. In one embodiment, substantially all of the third panel is disposed between the pocket panel and the body panel.

Disposition of the third panel between the pocket panel and the body panel serves to space at least a portion of the pocket panel from an underlying portion of the body panel to provide opening of the pocket space along the longitudinal centerline of the bib.

In one embodiment, the third panel has a lateral width which is greater than the lateral width of the pocket space. Such an arrangement provides the advantage that at least a portion of the third panel is deformed from a planar configuration, such as by folding or wrinkling, as it is disposed in the pocket space. Such deformation of the third panel aids in spacing the pocket panel from the body panel. Alternatively, the third panel can have a lateral width which is substantially equal to the lateral width of the pocket space. In yet another embodiment, the third panel can have a lateral width which is less than the lateral width of the pocket space.

The third panel can have a longitudinal length which is greater than the longitudinal length of the pocket space, or alternatively, the third panel can have a longitudinal length which is less than, or substantially equal to, the longitudinal length of the pocket space.

In one embodiment, the third panel has a generally rectangular shape. The third panel has a first end joined to the pocket panel at a fold, the fold defining the pocket space open edge. The third panel also has a laterally extending bottom edge spaced from the first end, and longitudinally extending side edges.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
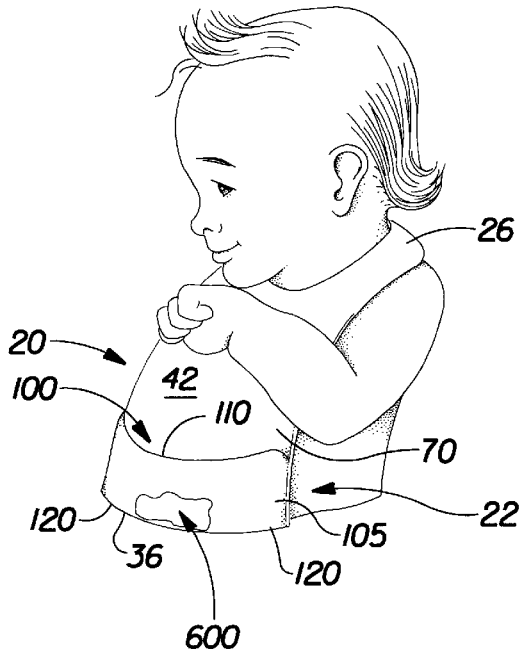
FIG. 1 is an in use perspective view of a disposable bib according to the present invention.
Figure 2:
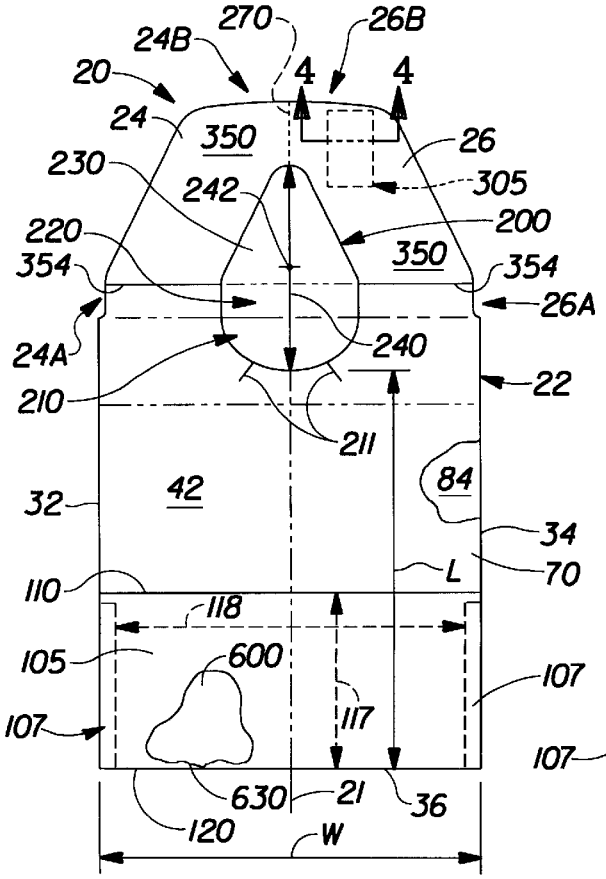
FIG. 2 is a front plan view of the disposable bib of the present invention wherein the bib is supported in a flat, generally planar orientation, and wherein a portion of the pocket panel is shown cut away to reveal a portion of the third panel.
Figure 3:
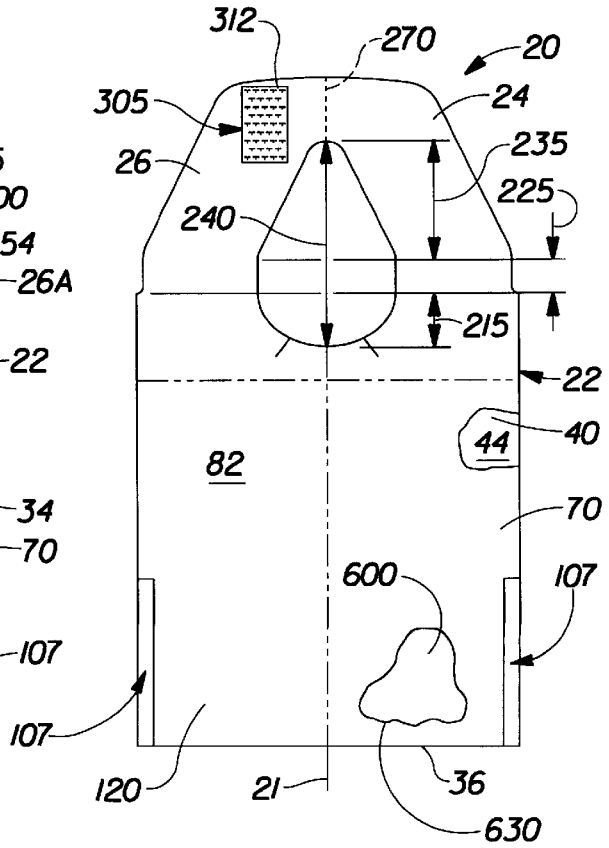
FIG. 3 is a rear plan view of a disposable bib of the present invention wherein a portion of the body panel is cut away to show the third panel.

FIGS. 1–3 illustrate a disposable bib 20 according to one embodiment of the present invention. By "disposable" it is meant that the bib is meant to be used once, and then discarded. The disposable bib 20 comprises a bib body 22 having longitudinally extending sides 32 and 34, a longitudinal length L, a longitudinal centerline 21, a laterally extending bottom edge 36, and a lateral width W.

The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

The bib 20 includes a pocket 100, for catching and receiving food particles. The bib body 22 comprises a first body panel 70, a second pocket panel 105, and a third panel 600. Portions of the body panel 70 and the pocket panel 105 are shown cut away in FIGS. 1–3 and FIG. 9 to reveal the third panel 600 extending into the pocket 100 to be disposed intermediate the body panel 70 and the pocket panel 105.

The body panel 70 is disposed adjacent the wearer's body when the bib is secured to the wearer. The pocket panel 105 can have a generally rectangular shape, and together with the body panel 70 forms a pocket 100 comprising a pocket space intermediate the body panel 70 and the pocket panel 105.

The pocket panel 105 extends longitudinally from a pocket bottom edge 120, which can also be the bib bottom edge 36, to a pocket open edge 110. The longitudinal length of the pocket space is measured along the longitudinal centerline 21 from the bottom edge 120 to the pocket open edge 110. The longitudinal length of the pocket space is designated by the reference number 117 in FIG. 2. The bottom edge 120 and the open edge 110 can both be substantially perpendicular to the longitudinal centerline 21 and substantially parallel to an imaginary lateral axis.

The pocket panel 105 extends laterally intermediate the bib side edges 32 and 34. The pocket panel 105 is joined to the underlying body panel 70 along the edges 32 and 34 at attachment zones designated by reference number 107. A securing means, such as adhesive, can be used to join the side edges of the pocket panel 105 to the body panel 70 in the attachment zones 107. The pocket space has a lateral width designated by reference number 118 in FIG. 2. The lateral width 118 of the pocket space corresponds to the minimum lateral spacing between the attachment zones 107.

The third panel 600 is joined to a portion of the bib 20 and extends at least partially into the pocket space intermediate the body panel 70 and the pocket panel 105. In one embodiment, the body panel 70, pocket panel 105, and third panel 600 can be formed from a continuous sheet of material, and the sheet of material may comprise one or more laminae. The pocket panel 105 can be joined to the body panel 70 at a laterally extending fold in the sheet material corresponding to the bib bottom edge 36. The third panel 600 can be joined to the pocket panel 105 by a laterally extending fold in the sheet material which corresponds to the pocket open edge 110.

The third panel 600 can have the shape of a quadrilateral, and more particularly, the third panel 600 can have a generally rectangular shape. Referring to FIGS. 2, 8, 9, and 11–13, the third panel 600 can have a first end 610 joined to the pocket panel 105 at the open edge 110. The third panel 600 can have a laterally extending bottom edge 630 which is spaced longitudinally from the first end 610. The third panel 600 can also have longitudinally extending side edges 620 which extend from the first end 610 to the bottom edge 630 of the third panel 600. The bottom edges 630 and side edges 620 are free edges, being unattached to other portions of the bib 20.

The third panel 600 spaces at least a portion of the pocket panel 105 from an underlying portion of the body panel 70 to provide opening of the pocket space along the longitudinal centerline 21. In particular, at least a portion of the third panel 600 extending into the pocket 100 can be deformed from a planar configuration, such as by folding or wrinkling, to provide spacing of a portion of the pocket panel 105 from the body panel 70.

Figure 13:
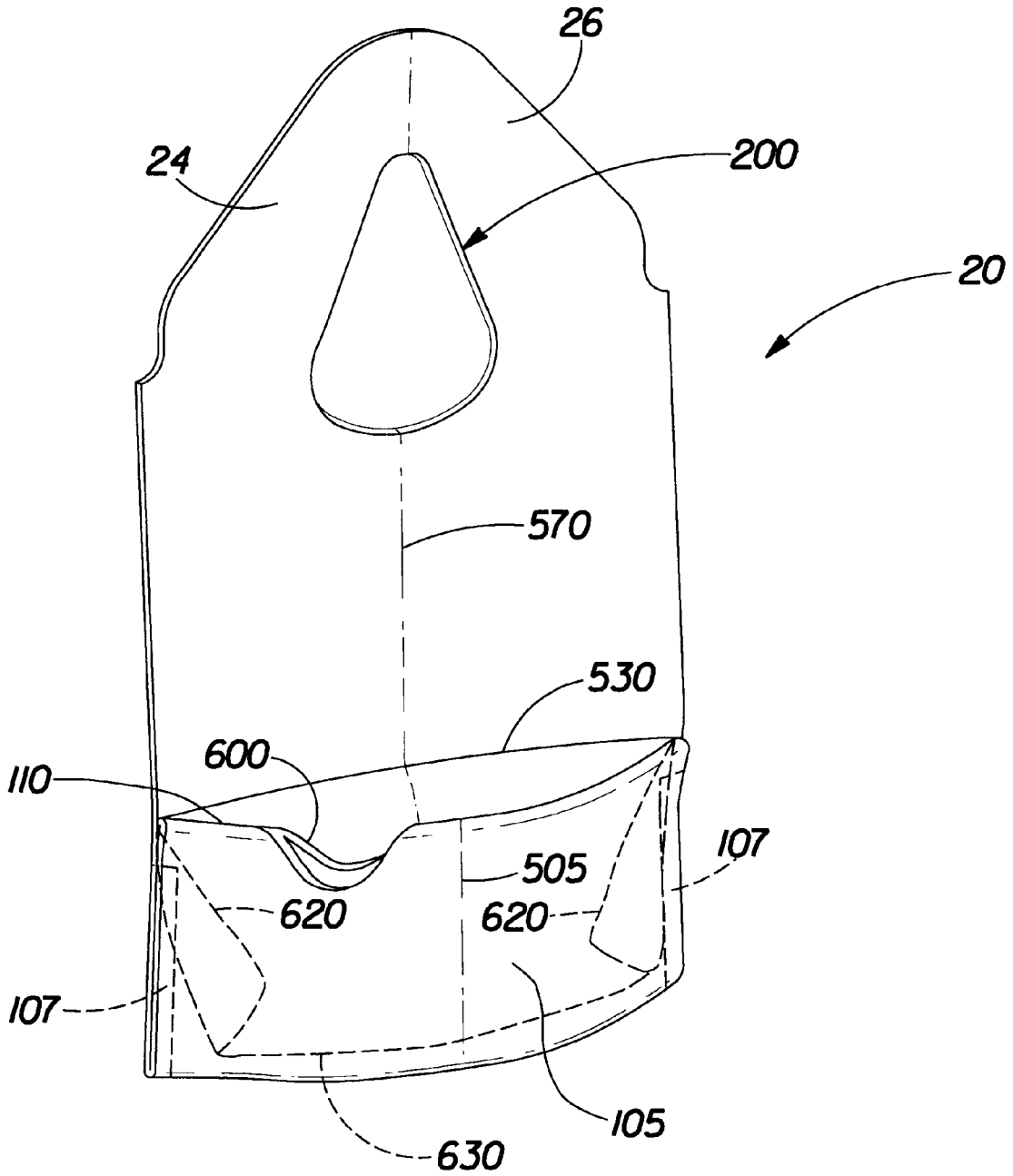
FIG. 13 is a perspective view of a bib according to the present invention, with folding of the side edges of the third panel being shown in phantom.

Preferably, the third panel 600 has a lateral width which is sized relative to the pocket space to promote deformation of the third panel 600 when the third panel is positioned between the body panel 70 and the pocket panel 105. The third panel 600 preferably has a lateral width which is greater than the lateral width 118 of the pocket space. The third panel 600 has a lateral width designated by reference number 618 in FIG. 8. When the third panel 600 is disposed in the pocket space, the third panel 600 is deformed from a planar configuration, such as by folding or wrinkling, due to the difference between the width 618 and the width 118. This deformation is illustrated in FIG. 9 and FIG. 13, which show the sides edges 620 of the third panel 600 folded toward the bib longitudinal centerline 21 and disposed between a portion of the panel 600 and the body panel 70. Such deformation of the side edges 620 helps maintain the pocket 100 in an open configuration.

Alternatively, the third panel 600 can have a lateral width 618 which is substantially equal to the lateral width 118 of the pocket space. In yet another embodiment, the third panel 600 can have a lateral width 618 which is less than the lateral width of the pocket space.

Figure 8:
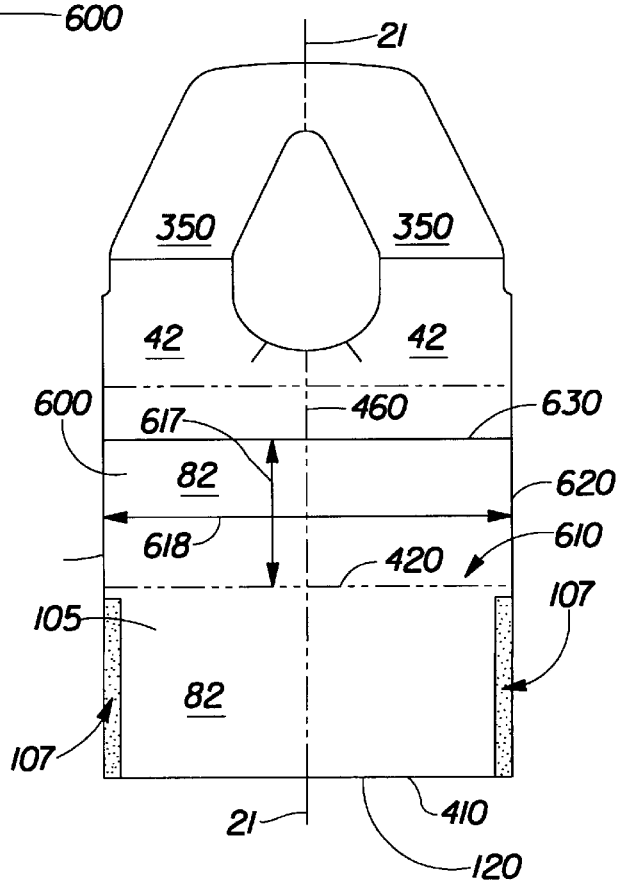
FIG. 8 is a front plan view of a partially assembled bib, wherein a portion of the bib body has been folded to position a pocket panel to overlie a portion of the bib body panel.
Figure 9:
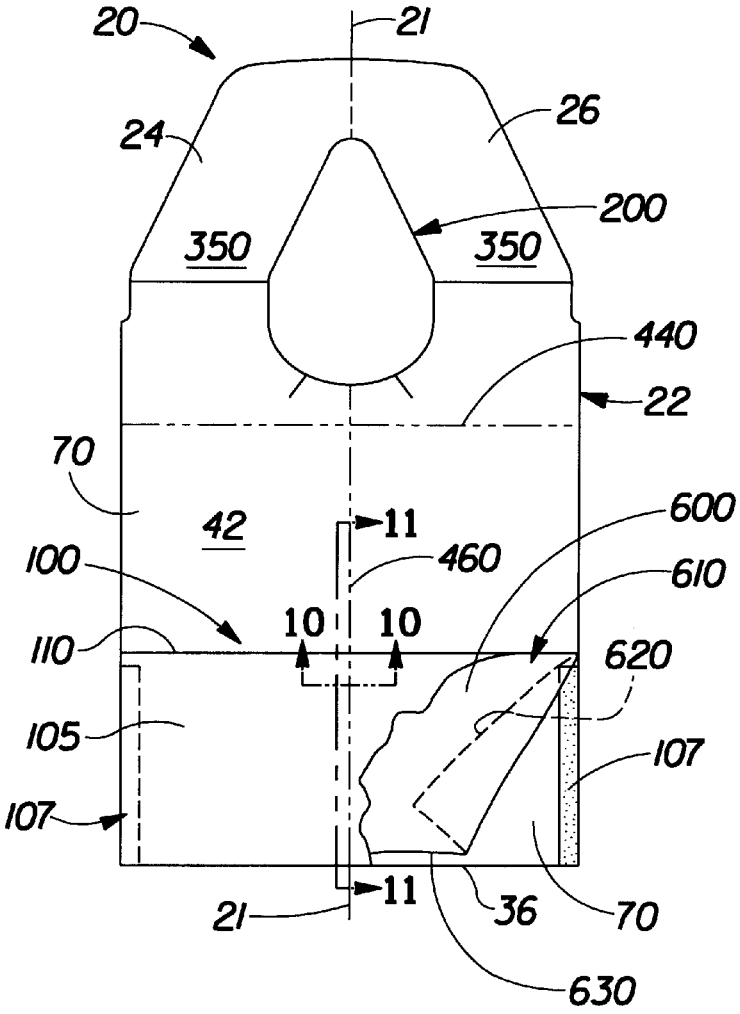
FIG. 9 is a front plan view of a bib wherein a portion of the bib body has been folded to position a third panel between the pocket panel and the body panel, and wherein a portion of the pocket panel is cut away to show folding of one of the side edges of the third panel due to the difference between the lateral width of the third panel and the lateral width of the pocket space.
Figure 11:
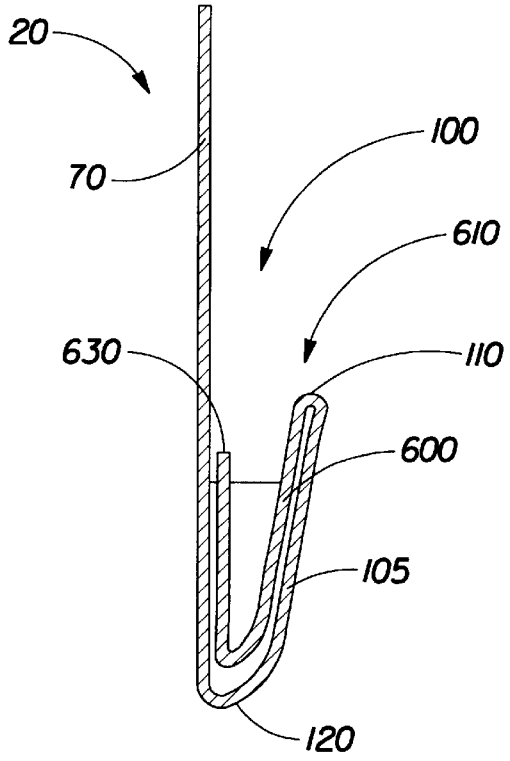
FIG. 11 is a cross-sectional view through the body panel, pocket panel, and the third panel, the view in FIG. 11 taken along lines 11—11 in FIG. 9, and showing a third panel having a longitudinal length which is greater than the longitudinal length of the pocket.
Figure 12A:
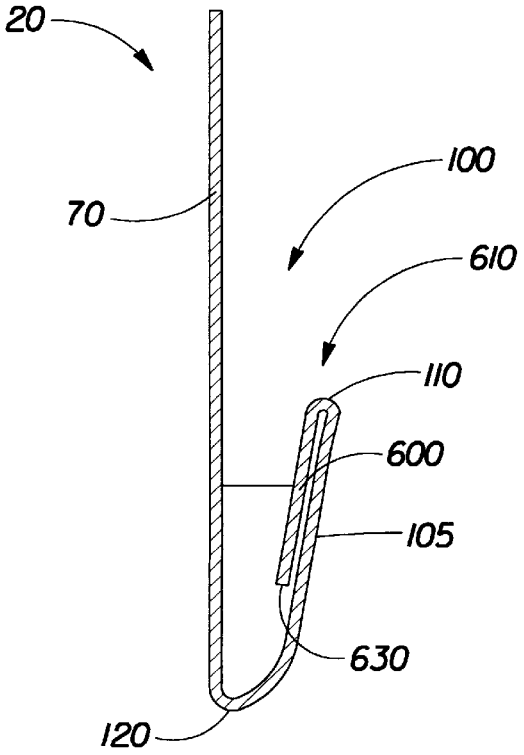
FIG. 12A is a cross-sectional view similar to that of FIG. 11, and showing a third panel having a longitudinal length which is less than the longitudinal length of the pocket.
Figure 12B:
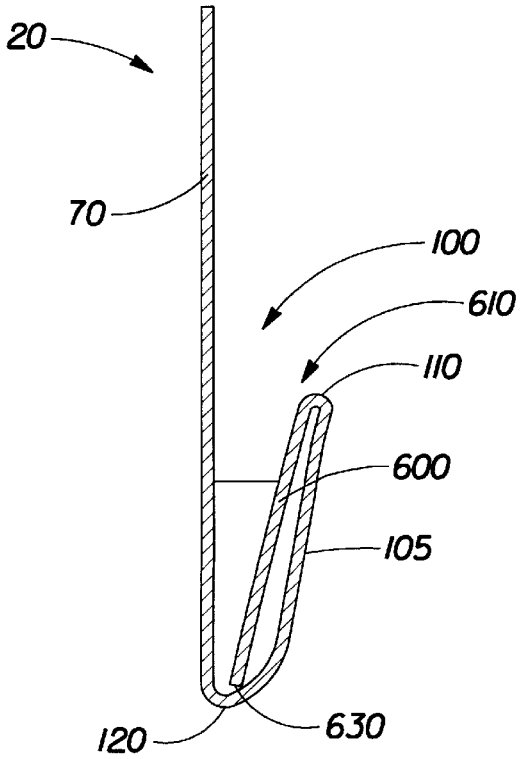
FIG. 12B is a cross-sectional view similar to that of FIG. 11, and showing a third panel having a longitudinal length which is substantially equal to the longitudinal length of the pocket.

The third panel 600 has a longitudinal length designated by reference number 617 in FIG. 8. In FIG. 11, the third panel 600 has a longitudinal length which is greater than the longitudinal length of the pocket space. Alternatively, the third panel 600 can have a longitudinal length which is less than, or substantially equal to, the longitudinal length 117 of the pocket space. In FIG. 12A, the third panel 600 has a longitudinal length which is at least 50 percent of the length 117, but less than 100 percent of the length 117. Alternatively, the third panel 600 can have a longitudinal length which is less than 50 percent of the length 117. In FIG. 12B, the longitudinal length of the panel 600 is substantially equal to the longitudinal length 117 of the pocket space. In one preferred embodiment, the longitudinal length of the third panel 600 is less than that of the pocket space, and the third panel 600 has a lateral width 618 which is greater than that of the pocket space.

Referring back to FIGS. 1–4, the bib 20 also comprises a pair of shoulder extensions 24, 26 having proximal ends 24A, 26A and distal ends 24B, 26B. The shoulder extensions 24, 26 extend from the bib body 22 from their proximal ends to their distal ends to provide a generally planar neck opening 200 when the bib is supported on a flat, horizontal surface.

The generally planar neck opening 200 has a front neck portion 210, a rear neck portion 230, and a maximum width portion 220 disposed intermediate the front neck portion 210 and the rear neck portion 230. The neck opening 200 also has a longitudinal length 240 measured along the longitudinal centerline 21. (FIG. 2)

The generally planar neck opening 200 is generally symmetric about a longitudinal axis, such as the longitudinal centerline 21, and is generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array 305 of projections 310 extending from a substrate 312 joined to the shoulder extension 26. The projections 310 are engagable with a landing surface, the landing surface being disposed on at least a portion of the shoulder extension 24.

Figure 4:
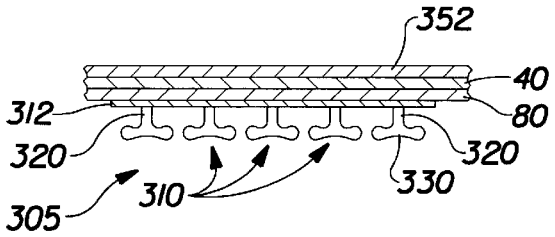
FIG. 4 is a cross-sectional view taken along lines 4—4 in FIG. 2.

In one embodiment, the projections 310 can comprise prongs, and the landing surface can comprise a target surface 350 of a nonwoven web 352 disposed on at least a portion of the shoulder extension 24 (FIGS. 2–4). In the embodiments shown, the web 352 is disposed on both the shoulder extensions 24, 26 to provide a soft, nonabrasive surface about the wearer's neck.

Referring to the components of the bib 20 in more detail, the bib 20 according to the present invention can comprise a composite construction having multiple laminae. Referring to FIGS. 1–3, the bib 20 can comprise a laminate of an absorbent outer topsheet layer 40 and a garment facing backsheet layer 80 which is liquid impermeable relative to the topsheet 40. The topsheet 40 has a first outer surface 42 for receiving spilled food material, and a second inner surface 44. The backsheet 80 has a first garment facing surface 82 and a second surface 84. The surface 84 of the backsheet 80 and the surface 44 of the topsheet 40 are oppositely facing surfaces, and can be joined together, such as with an adhesive, to form a laminate. In one embodiment, the shoulder extensions 24, 26, the bib body panel 70, the pocket panel 105, and the third panel 600 are formed from a single, continuous sheet of the laminate of the topsheet 40 and the backsheet 80.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat. Nos. 4,191,609; 4,440,597; 4,529,480; 4,637,859; 5,223,096; and 5,240,562. A suitable topsheet 40 can be formed from a single ply or multiple ply paper towel, such as a Bounty Paper Towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.5 mil (0.0005 inch) and about 3.0 mils (0.003 inch). In one embodiment the backsheet can comprise a FS-II embossed polyethylene film having a thickness of about 2 mils and manufactured under the designation CPC-2 (P-10392) by Tredegar Film Products of Cincinnati, Ohio.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. One particular adhesive which is suitable for joining the topsheet 40 to the backsheet 80 is an HL-1258 adhesive manufactured by H. B. Fuller Co. of St. Paul, Minn. Other suitable adhesives include Findley Adhesives H2031 and H2120 available from Findley Adhesives of Elmgrove, Wis.

The mechanical fastener can comprise an array 305 of polyolefinic prongs 310 extending from a polyolefinic substrate 312. In one embodiment, the prongs 310 comprise a prong shank 320 extending from a prong base proximal the substrate 312 to a prong end 330 having a width greater than the width of the prong shank. The array 305 can comprise between about 600 and about 3600 prongs 310 per square inch, each having a prong end 330 having an edge which extends radially outward from the prong shank around the entire circumference of the prong shank, the prong end 330 having a generally rounded edge. Such an array of prongs 310 provides a relatively soft, non-abrasive surface to reduce irritation of the wearer's skin.

In one embodiment, the array 305 can include about 900 prongs 310 per square inch. The array of prongs 310 can be non-directionally oriented, as compared to some arrays of hook shaped elements, which arrays can have a particular directionality which depends on the orientation of the hook shaped elements. A suitable fastener comprising a substrate 312 having pressure sensitive adhesive disposed on a first surface of the substrate and a non directional array 305 of prongs 310 extending from a second, opposite surface of the substrate is manufactured by the 3M Company of St. Paul, Minn. under the designation XPH-4152.

In another embodiment, the array 305 of prongs 310 can comprise about 2500 prongs per square inch, and can comprise a fastener manufactured by the 3M Co. under the designation XPH-4182.

In an alternative embodiment, the fastener can comprise an array 305 of hook shaped elements. A suitable fastener comprising hook shaped elements is manufactured by the 3M Company under the designation KN0513.

The following documents are incorporated by reference for the purpose of disclosing suitable arrays of target surface engaging elements, including directional and non-directional arrays, and including hook shaped and non-hook shaped target engaging elements: U.S. Pat. No. 4,216,257 issued Aug. 5, 1980; U.S. Pat. No. 4,846,815 issued Jul. 11, 1989; U.S. Pat. No. 4,894,060 issued Jan. 16, 1990; U.S. Pat. No. 5,392,498 issued Feb. 28, 1995; U.S. Pat. No. 5,326,612 issued Jul. 5, 1994; and U.S. Pat. No. 5,407,439 issued Apr. 18, 1995; and PCT Publication WO 94/23610 published Oct. 27, 1994.

The target surface 350 can comprise the surface of a nonwoven web of fibers 352 disposed on at least a portion of the shoulder extensions 24 and 26 to cover an upper portion of the surface 42 of topsheet 40. In the embodiment shown in FIG. 2, the target surface 350 extends over the majority of the outer surface of the shoulder extensions 24 and 26, and terminates at a lower edge 354. The edge 354 is located adjacent to the juncture of the rear neck opening portion 230 with the maximum width neck portion 220.

Accordingly, the nonwoven web extends over portions of the shoulder extensions which can come in contact with the wearer's skin, such as portions of the shoulder extensions 24 and 26 which are bounded by the rear neck opening portion 230, and presents a soft, non-irritating surface to the wearer's skin. In alternative embodiment, the nonwoven web can extend below the perimeter 201 of the front neck opening portion 210, and can cover all or a portion of the body panel 70. The nonwoven web 352 can have the characteristic that it permits liquids to pass through to the absorbent topsheet layer 40, while the surface 350 remains relatively dry to the wearer's touch. In addition, the nonwoven web 352 can contribute to the absorbency of the bib by creating void space intermediate the nonwoven web 352 and the topsheet 40.

The nonwoven web 352 is selected so that the prongs 310 can securely engage the fibers of the web 352. In one embodiment, the target surface 350 can comprise the surface of a web 352 of spunlaid, thermally point bonded polypropylene fibers, the web having a basis weight of about 22 grams per square meter and the fibers having an average denier less than about 3.0 grams per 9000 meter of fiber length. A suitable nonwoven web 352 is manufactured by the Fiberweb Corp. of Simpsonville, S.C. under the designation Celestra Unicorn. Such a web of fibers provides a target surface which can be securely engaged by the above listed prongs 310, and which is soft and nonabrasive to the wearer's skin.

Figure 5:
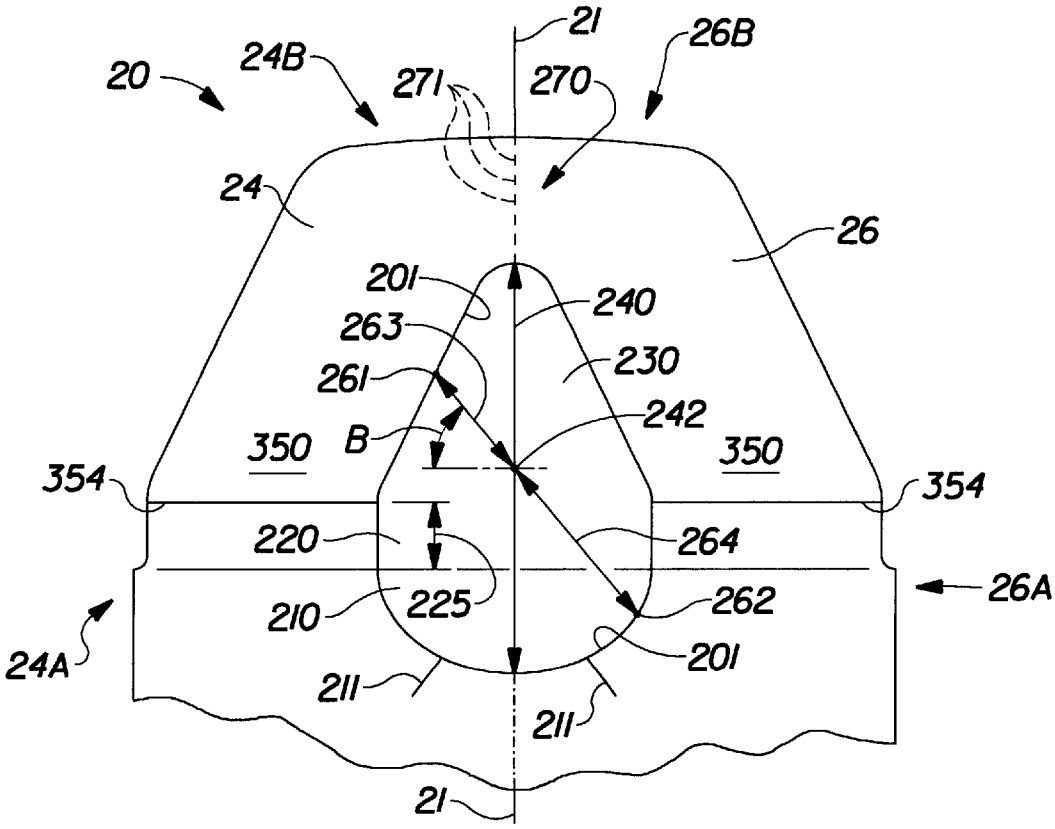
FIG. 5 is an enlarged, partial schematic illustration of a neck opening having a closed shape, the figure illustrating measurement of the lateral asymmetry ratio and angle B when the bib is supported in a flat, generally planar orientation.
Figure 6:
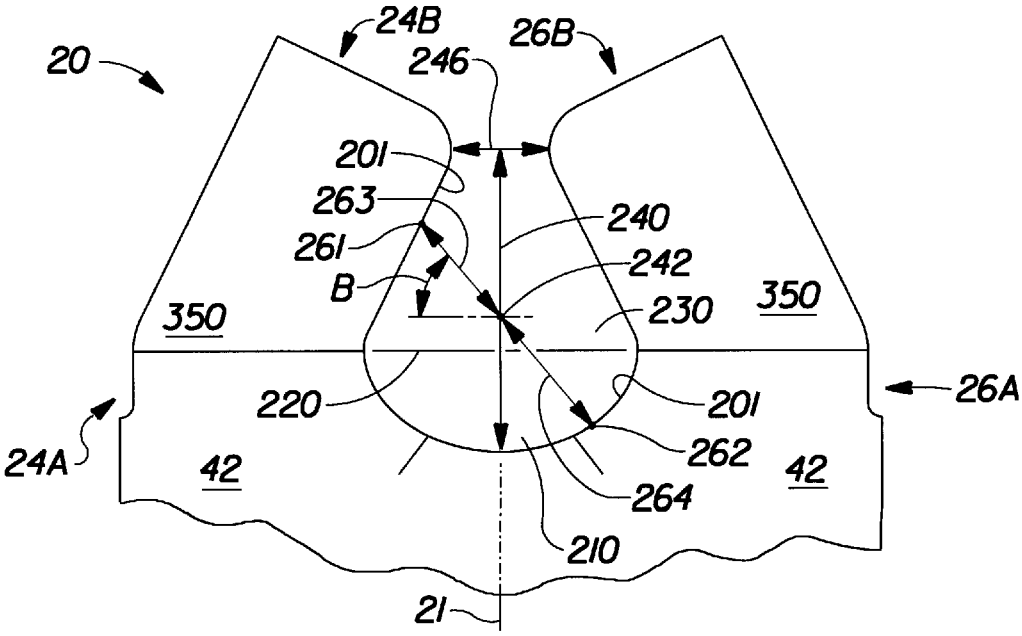
FIG. 6 is an enlarged, partial schematic illustration of a neck opening having an open shape.

The generally planar neck opening 200 can have a closed shape, as shown in FIG. 5, or an open, rearwardly converging shape, as shown in FIG. 6. In either case, the maximum lateral width of the opening 200 is located in the maximum width portion 220 disposed intermediate the front and rear neck portions. The maximum lateral width located in the maximum width portion 220 is greater than lateral widths measured in the front and rear neck opening portions. In contrast, U shaped and V-shaped neck openings are not rearwardly converging, and do not include a maximum width portion disposed intermediate a front neck opening portion and a rear neck opening portion.

The maximum width portion 220 of the opening 200 can have a finite longitudinal length 225, as shown in FIG. 5 (e.g. the portion 220 has a generally rectangular shape), or alternatively, the maximum width portion 220 can be a line of maximum width, as shown in FIG. 6. The longitudinal length 225 of the maximum width portion 220 can be less than the longitudinal length 215 of the front neck opening portion 210, as measured along the longitudinal centerline 21.

If the neck opening has a closed shape, the length 240 is measured along the longitudinal centerline 21 between opposite points on the perimeter 201 of the opening 200. If the neck opening 200 has an open, rearwardly converging shape, as shown in FIG. 6, the minimum lateral width 246 separating the edges of the shoulder extensions 24 and 26 in the rear neck opening portion is first identified. The longitudinal length 240 is then measured along the longitudinal centerline 21 from the front neck opening portion 210 to the midpoint of the lateral width 246. If there are multiple locations in the rear neck portion 230 having the minimum lateral width 246, the length 240 is measured from the front neck opening to the midpoint of the minimum lateral width 246 positioned closest to the front neck opening portion 210.

The front neck opening portion 210 can have a perimeter 201 comprising a shape which is generally concave with respect to the center of the neck opening (i.e. concave upward as the bib is worn) as shown in FIG. 5. The perimeter 201 of the front neck portion 210 can comprise any number of commonly recognized geometric shapes, including but not limited to oval, circular, parabolic, or elliptical shapes. Alternatively, the perimeter of the front neck portion 210 could comprise one or more straight line segments, one or more curved segments, or a combination of straight line segments and curved segments.

A plurality of slits 211 can extend in a generally radial fashion from the perimeter 201 of the front neck opening portion 210. The slits 211 provide a close yet comfortable fit of the perimeter 210 of front neck opening portion 210 against the wearer's neck. The slits 211 allow the resulting petal like portions of bib intermediate the slits 211 to slide over each other as the shoulder extensions 24, 26 are overlapped. The slits 211 thereby help reduce distortion and gapping of the bib body as the neck opening 200 is made to conform to the wearer's neck. Accordingly, the slits 211 cooperate with the shape of the neck opening 200 to improve fit of the bib about the wearer's neck, and reduce distortion and gapping of the bib body as the shoulder extensions 24, 26 are overlapped to accommodate a particular neck size. Such slits, or bifurcations, are disclosed generally in U.S. Pat. No. 4,416,025 to Moret, which Patent is incorporated herein by reference.

The rear neck opening portion 230 can have a perimeter 201 comprising straight line segments, curved segments, or a combination of straight line segments and curved segments. In FIGS. 5 and 6, the perimeter of the rear neck portion 230 comprises generally straight line segments defined by the inside edges of the shoulder extensions 24 and 26. These straight line segments are convergent, but do not necessarily intersect, as the rear neck opening portion 230 extends from the maximum width portion 220, such that the rear neck opening portion 230 is tapered as it extends from the maximum width portion 220. The concave perimeter of the front neck opening portion 210 and the tapered rear neck opening portion 230 provide a teardrop shaped neck opening 200, as shown in FIG. 5. FIG. 6 shows a teardrop shaped neck opening 200 which is truncated.

The rear neck opening portion 230 can have a longitudinal length 235 which is greater than the longitudinal length 215 of the front neck opening portion 210, as shown in FIG. 3. In one embodiment, the longitudinal length 235 is at least about 1.2 times, in another embodiment, at least about 1.5 times, and in still another embodiment, at least about 2.0 times the longitudinal length 215. For instance, in one nonlimiting embodiment, the length 215 can be about 1.2 inches, the length 225 can be about 0.64 inch, the length 235 can be about 2.7 inch, and the lateral width of the maximum width portion 220 can be about 3.4 inch.

Varying neck sizes and shapes having a lateral width less than that of the maximum width portion 220 can be accommodated by overlapping the shoulder extensions 24 and 26 to different degrees. Overlapping the shoulder extensions 24 and 26 to releasably fasten the shoulder extensions behind the wearer's neck will generally cause at least some distortion of the bib body 22, which can cause the bib body 22 to gap away from the wearer's chest. This distortion will generally increase as the shoulder extensions are overlapped to a greater degree.

The bib of the present invention provides a neck opening 200 which, for a given maximum lateral width and perimeter of the opening 200, securely fits a wide range of neck sizes and shapes while minimizing the above mentioned distortion and gapping. Bibs with shoulder extensions defining a circular neck opening when the bib is in a generally planar orientation will generally exhibit high distortion when the shoulder extensions are overlapped to fit necks significantly smaller than the diameter of the circular opening. Bibs having a neck opening with a laterally elongated oval shape (major axis oriented laterally) will also exhibit significant distortion as the shoulder extensions are overlapped to accommodate smaller neck sizes.

Bibs with shoulder extensions defining a longitudinally elongated oval shaped neck opening (major axis oriented longitudinally) when the bib is in a generally planar orientation can exhibit less distortion than bibs having laterally elongated openings. However, such a neck opening shape may act as a slot, allowing the bib to shift longitudinally relative to the wearer. Bibs having shoulder extensions defining a U or V-shaped neck opening when the bib is in a generally planar orientation can also exhibit excessive distortion when the shoulder extensions are overlapped, and can also shift longitudinally. The shoulder extensions 24 and 26 engage the rear portion of the wearer's neck at varying degrees of overlap to accommodate a wide arrange of neck sizes, while reducing the amount of distortion of the bib body 22 which would otherwise occur as the overlap is increased to accommodate relatively smaller neck sizes.

The generally planar neck opening 200 can have a lateral asymmetry ratio greater than 1.0. In some embodiments, the ratio can be at least about 1.15, in other embodiments at least about 1.25, in yet other embodiments at least about 1.5. A bib opening 200 having longitudinal symmetry and a lateral asymmetry ratio greater than 1.0 provides the advantage that the perimeter 201 of the rear neck opening portion can engage the back portion of necks of various size with minimal distortion and gapping of the bib body 22. Referring to FIGS. 5 and 6, the lateral asymmetry ratio is measured using the following procedure.

The bib 20 is supported on a flat, horizontal surface to provide a generally planar neck opening 200. A "generally planar neck opening 200" is provided when the shoulder extensions 24, 26 and the body panel 70 are in substantially the same plane and the shoulder extensions 24, 26 are in a non-overlapping configuration. The midpoint 242 of the length 240 is then located, such as with a ruler having its edge placed over the bib and along the centerline 21. The location of the midpoint can be marked on the flat, horizontal surface. An imaginary line is then constructed which extends through the midpoint 242 of the longitudinal length 240 of the neck opening and which intersects the perimeter 201 of the neck opening 200 at two points: a first intersection point 261 located on the perimeter of the rear neck portion 230 and a second intersection point 262 in an opposite portion of the perimeter of the neck opening (points 261, 262, and 242 are collinear). The location of point 261 is chosen so that the ratio of the distance 264 (measured from the midpoint 242 to the second point 262) to the distance 263 (measured from the midpoint 242 to the first point 261) is maximum. This ratio, obtained by dividing distance 264 by distance 263, is the asymmetry ratio of the neck opening 200.

In one embodiment the generally planar neck opening 200 has a lateral asymmetry ratio within a particular angular portion of the neck opening 200, as defined by an angle B. It is desirable that the generally planar neck opening 200 have a lateral asymmetry ratio exceeding 1.0 within a particular angular portion of the neck opening so that the neck opening can securely engage the back portion of the wearer's neck with a component of force which prevents slipping or shifting of the bib relative to the wearer.

Referring to FIGS. 5 and 6, angle B is measured from a lateral axis passing through midpoint 242. In one embodiment, the neck opening 200 has an asymmetry ratio of at least about 1.15, in another embodiment at least about 1.25, and in yet another embodiment at least about 1.5, wherein the asymmetry ratio is positioned within an angular portion of the neck opening defined by: 15 degrees<B<80 degrees, more particularly, within an angular portion defined by 30 degrees<B<75 degrees.

Prior to the time the bib is to be used, the shoulder extensions 24 and 26 can be joined together, such as at their distal ends 24B, 26B, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 extend partially or fully through the thickness of the bib 200. The perforations can be formed with a perforating knife, and can extend through each of the backsheet 80, topsheet 40, and nonwoven web 352.

The selective line of weakening 270 provides the advantage that the distal ends of the shoulder extensions are interconnected, rather than loose, prior to use. The bib is therefore easier to handle prior to use. In addition, the use of a selective line of weakening provides for ease of manufacturing. For instance, the bibs 20 can be manufactured by joining together continuous webs of the backsheet 80 material, the topsheet 40 material, and the nonwoven 352 material to form a continuous, multiple laminae sheet. The multiple laminae sheet can then be perforated at predetermined positions corresponding to the desired location of each bib to be cut from the sheet.

The bibs can then be cut from the sheet according to a predetermined pattern. Accordingly, there is no need to attempt to position or support loose distal ends of the shoulder extensions during manufacturing.

The bib 20 of the present invention can comprise one or more creases positioned in predetermined locations. The creases can be formed by folding the bib 20 for packaging. The creases can be positioned to facilitate opening of the pocket 100, and maintaining the pocket 100 in an open configuration.

Figure 7:
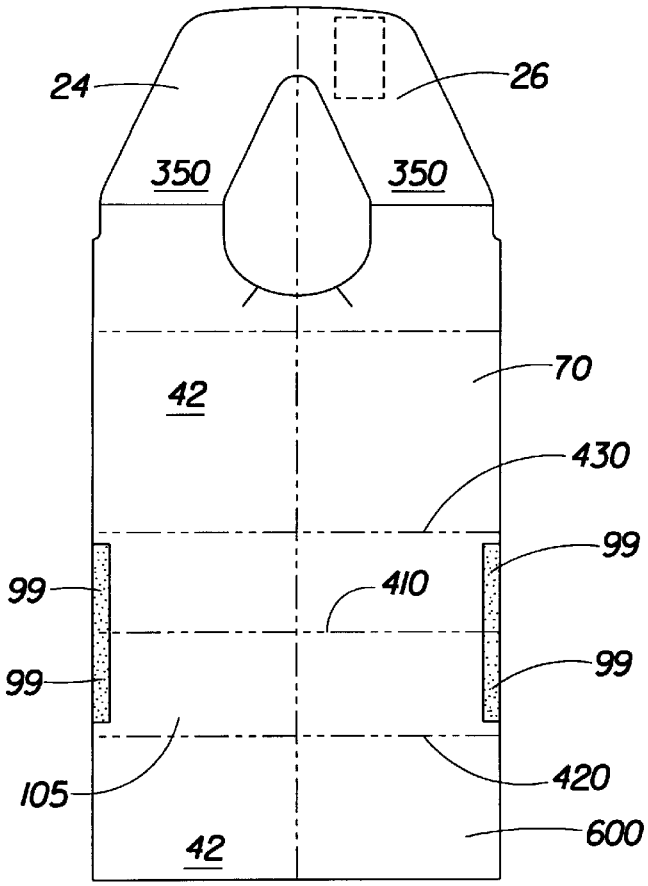
FIG. 7 is a front plan view of a partially assembled bib showing the outer perimeter of the bib and the neck opening, and prior to folding of the bib body to form a pocket panel and a third panel.

FIG. 7 shows a partially constructed bib structure. In FIG. 7, the neck opening 200 and the outer perimeter of the bib have been cut from a sheet of material comprising a topsheet 40 layer adhesively joined to a backsheet 80 layer. In addition, a nonwoven web 352 has been secured to cover the shoulder extensions 24 and 26. In FIG. 7, the pocket 100 has not yet been formed.

In FIG. 7, adhesive 99 has been applied along the edges of the partially constructed bib. The adhesive 99 is used to form attachment zones 107, thereby securing the edges of the pocket panel 105 to the body panel 70. Other suitable means for securing the edges of the pocket panel 105 to the body panel 70 include but are not limited to thermal bonding, mechanical bonding, and ultrasonic bonding.

The partially constructed bib can then be folded along a fold line 410, as shown in FIGS. 7 and 8, to create pocket bottom edge 120, and to position the pocket panel 105 adjacent the body panel 70, such that the pocket panel 105 overlies a bottom portion of the body panel 70. The adhesive 99 joins the longitudinally extending edges of the pocket panel 105 to the bottom portions of the longitudinally extending edges of the body panel 70, such that the pocket 100 is closed along the pocket bottom edge 120 and along it longitudinally extending side edges.

The pocket panel 105 is preferably seamless intermediate its longitudinally extending edges, such that pocket panel 105 extends as a single unitary panel intermediate its longitudinally extending edges. Seams, such as those formed by joining together two edges of pieces of material with adhesive, are undesirable in the pocket panel 105 because they require added construction steps, and because seams can affect the operation of the creases formed in the panel by folding.

The partially constructed bib can then be folded along a fold line 420 which is parallel to a lateral axis, as shown in FIG. 9, to create a crease forming the pocket open edge 110, with the third panel 600 being tucked into the pocket 100 such that the third panel 600 extends into the pocket 100 and is disposed between the pocket panel 105 and the body panel 70.

In one embodiment, the body panel 70 can also be folded along a laterally extending fold line 430. The fold line 430 is generally parallel to, and underlies, the pocket open edge 110. Folding the body panel 70 along the fold line 430 creates a crease 530 (FIG. 13) in the body panel 70 which is generally parallel to, and underlies, the pocket open edge 110.

The bib body panel 70 can next be folded along fold line 440 so that the shoulder extensions 24, 26 overlie a portion of the bib body panel and the pocket panel 105. The bib body panel can be folded along fold line 440 with the bib in the configuration shown in FIG. 8, so that portions of both the panels 105 and 600 are directly subjacent the shoulder extensions 24, 26. Alternatively, the bib can be folded along fold line 440 with the bib in the configuration shown in FIG. 9.

The bib 20 can also be folded along a longitudinally extending fold line 460 to form at least one longitudinally extending crease in each of the body panel 70, the pocket panel 105, and the third panel 600. Without being limited by theory, it is believed that such creases aid in maintaining the pocket 100 in an open configuration.

Depending on the configuration of the bib when the fold along line 460 is made, the resulting creases in the body panel 70, the pocket panel 105, and the third panel 600 can be convex outward or concave outward.

For instance, if the bib is in the configuration shown in FIG. 8 when it is folded along fold line 460, the bib can be folded so that edges of the bib are rotated upward out of the plane of FIG. 8. Then, when the bib is in the configuration shown in FIG. 9, longitudinal creases will be as shown in FIG. 10, which is a cross-sectional view through the panels of the bib taken along line 10—10 in FIG. 9.

Figure 10:
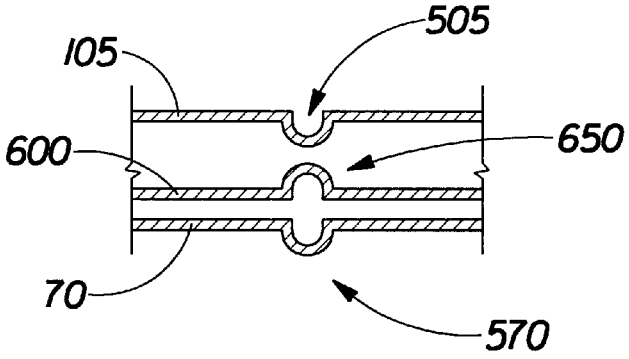
FIG. 10 is a cross-sectional view through the body panel, pocket panel, and third panel taken along lines 10—10 in FIG. 9, and showing a body panel having a concave outward crease, a pocket panel having a concave outward crease, and a third panel having a convex outward crease.

Referring to FIG. 10, such folding provides a longitudinally extending crease 650 on the third panel 600, a longitudinally extending crease 505 on the pocket panel 105, and a longitudinally extending crease 570 on the portion of the body panel 70 subjacent the pocket panel. The crease 650 is convex outward, and the creases 505 and 570 are concave outward (outward is the direction away from the wearer's body as the bib is worn, so that the convexity of the crease 650 in the third panel 600 is opposite to that of the crease 570 in the body panel 70. Without being limited by theory, the concave outward nature of crease 570 is believed to help channel spilled materials into the pocket 100.

Other crease arrangements can also be constructed, such that the creases 650, 505, and 570 are: all convex outward or all concave outward; 650 and 570 convex outward, 505 concave outward; 650 convex outward, 505 concave outward, and 570 convex outward; 650 concave outward, 505 and 570 convex outward; 650 and 505 concave outward, 570 convex outward; or 650 concave outward, 505 convex outward, and 570 concave outward.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed:

1. A disposable bib having a longitudinal centerline, a lateral width, and longitudinally extending side edges, the bib comprising:

a first body panel;

a second pocket panel joined to the body panel for providing a pocket space intermediate the body panel and the pocket panel, the pocket space having a pocket open edge, a pocket longitudinal length and a pocket lateral width; and a third panel extending at least partially into the pocket space, the third panel comprising a first end joined to the pocket panel, a laterally extending bottom edge spaced from the first end, and longitudinally extending side edges, wherein the side edges and the bottom edges are free edges.

2. The disposable bib of claim 1 wherein the third panel spaces at least a portion of the pocket panel from an underlying portion of the body panel to provide opening of the pocket space along the longitudinal centerline of the bib.

3. The disposable bib of claim 2 wherein at least a portion of the third panel extending into the pocket space is deformed from a planar configuration.

4. The disposable bib of claim 1 wherein the third panel has a lateral width greater than, or substantially equal to, the lateral width of the pocket space.

5. The disposable bib of claim 4, wherein the third panel has a lateral width greater than the lateral width of the pocket space.

6. The disposable bib of claim 1 wherein the third panel has a longitudinal length which is less than the longitudinal length of the pocket space.

7. The disposable bib of claim 1 wherein the third panel has a longitudinal length which is greater than the longitudinal length of the pocket space.

8. The disposable bib of claim 1 wherein the third panel has a longitudinal length which is substantially equal to the longitudinal length of the pocket space.

* * * * *